US006408655B1

(12) United States Patent
Ossensi et al.

(10) Patent No.: US 6,408,655 B1
(45) Date of Patent: Jun. 25, 2002

(54) DEVICE FOR SELECTIVELY FEEDING THREADS IN KNITTING MACHINES OR THE LIKE

(75) Inventors: Severino Ossensi, Viggiu' ; Dionigi Fantini, Ghirla, both of (IT)

(73) Assignee: Mec-Mor S.r.l., Induno Olona (IT)

( * ) Notice: Subject to any disclaimer, the term of this patent is extended or adjusted under 35 U.S.C. 154(b) by 0 days.

(21) Appl. No.: 09/959,685

(22) PCT Filed: May 17, 2000

(86) PCT No.: PCT/EP00/04456

§ 371 (c)(1),
(2), (4) Date: Nov. 5, 2001

(87) PCT Pub. No.: WO00/73564

PCT Pub. Date: Dec. 7, 2000

(30) Foreign Application Priority Data

May 26, 1999 (IT) ..... MI99A1168

(51) Int. Cl.[7] ..... D04B 27/10
(52) U.S. Cl. ..... 66/140 R
(58) Field of Search ..... 66/125 R, 134, 66/135, 136, 137, 139, 140 R, 142

(56) References Cited

U.S. PATENT DOCUMENTS 3,572,059 A * 3/1971 Goadby ..... 66/140 S
4,656,842 A 4/1987 Sawazaki et al.
6,000,245 A * 12/1999 Plath et al. ..... 66/139

FOREIGN PATENT DOCUMENTS

DE 003606611 A1 * 9/1986 ..... 66/142
DE 003725171 A1 * 2/1988 ..... 66/142
GB A-219 6026 4/1988

* cited by examiner

*Primary Examiner*—Danny Worrell
(74) *Attorney, Agent, or Firm*—Guido Modiano; Albert Josif; Daniel O'Byrne

(57) ABSTRACT

A device for selectively feeding threads in knitting machines or the like, which comprises a set of fixed stripers (3) arranged mutually side by side on the outer side of the needle bed or beds **(4*a*,4*b*) of the machine. Each striper (3) has a passage (5) for a thread (6) to be fed to the needles (7) of the machine, and an element (8) for clamping and cutting the thread (6) arriving from the corresponding striper (3) is provided for each striper (3). Each clamping and cutting element (8) is movable from a standby position, in which it is laterally adjacent to the corresponding striper (3) on the outer side of the needle bed (4*a*,4*b*) of the machine and clamps the thread (6) arriving from the corresponding striper (3), to an active position, in which at least its region that engages the thread (6) is arranged on the inner side of the needle bed (4*a*,4*b*) of the machine in order to arrange the thread (6) transversely to the needle bed (4*a*,4*b*) of the machine and then release it, and vice versa, in order to clamp and cut the thread (6) arriving from the corresponding striper (3). First actuators are provided which comprise a programmable electronic controller (60) for the individual actuation, according to a preset program, of each clamping and cutting element (8)** for its transfer from the standby position to the active position and vice versa.

12 Claims, 5 Drawing Sheets

DEVICE FOR SELECTIVELY FEEDING THREADS IN KNITTING MACHINES OR THE LIKE

BACKGROUND OF THE INVENTION

The present invention relates to a device for selectively feeding threads in knitting machines or the like.

Conventional devices for selectively feeding threads in knitting machines in order to form patterns or lines on the resulting knitted fabric generally comprise a set of elements known as "stripers" arranged side by side and facing the needle bed or beds of the machine with an end at which there is a passage for the thread to be fed to the needles of the machine. Each striper is provided with an element for clamping and cutting the thread fed by the corresponding striper.

In most of the conventional devices, the thread clamping and cutting elements are arranged on the inner side of the needle bed of the machine and each striper is movable on command from the inner side of the needle bed toward the outer side in order to engage the thread clamped by the corresponding clamping and cutting element and arrange it transversely to the needle bed.

The thread thus arranged is then captured, in some kinds of machine, by a hook rigidly coupled to the needle beds and lowers said thread until it is deposited in the selvage retention clamps located at the beginning of the needle bed. Then the clamping and cutting element releases the thread, which is knitted in by the needles of the machine. In other kinds of machine, the thread dispensed by the striper is knitted in directly by the needles.

After knitting said thread and usually at the end of the needle bed, the striper is moved again toward the inside of the needle bed, toward the corresponding clamping and cutting element, which clamps and cuts the thread.

GB-2 196 026 discloses a striping device in a circular knitting machine wherein the stripers are movable and the cutting device performs cutting with a rotating movement.

U.S. Pat. No. 4 656 842 discloses a striping device wherein the stripers are also movable.

In other kinds of device, the stripers are fixed and are arranged on the outer side of the needle bed of the machine, while the corresponding clamping and cutting means are movable from the outside of the needle bed toward the inside and vice versa in order to arrange the thread transversely to the needle bed.

The actuation of the stripers or of the thread clamping and cutting elements in order to arrange the thread transversely to the needle bed of the machine is generally performed by way of cams applied to the needle bed, which is usually movable with respect to the stripers; said cams act on the stripers or on the clamping and cutting elements by way of levers and transmissions.

Accordingly, the patterns that can be achieved with conventional stripers are rather limited, since it is of course not possible to vary, during knitting, the arrangement and configuration of said cams in order to vary the thread or threads that are fed to the needles and to vary their feeding sequence.

SUMMARY OF THE INVENTION

The aim of the present invention is to solve the above problem, by providing a device for selectively feeding threads in knitting machines or the like which allows to produce patterns which are more complex and varied with respect to those that can be obtained with conventional devices.

Within the scope of this aim, an object of the invention is to provide a device which allows to vary, according to the requirements, the insertion and extraction points of the threads without requiring mechanical interventions on the machine.

Another object of the invention is to provide a device which allows to vary the insertion points of the threads row by row.

Another object of the invention is to provide a device which, besides providing greater operating flexibility, also allows to structurally simplify the machine on which it is installed.

This and other objects which will become better apparent hereinafter are achieved by a device for selectively feeding threads in knitting machines or the like, as claimed in claim 1.

BRIEF DESCRIPTION OF THE DRAWINGS

Further characteristics and advantages of the invention will become better apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
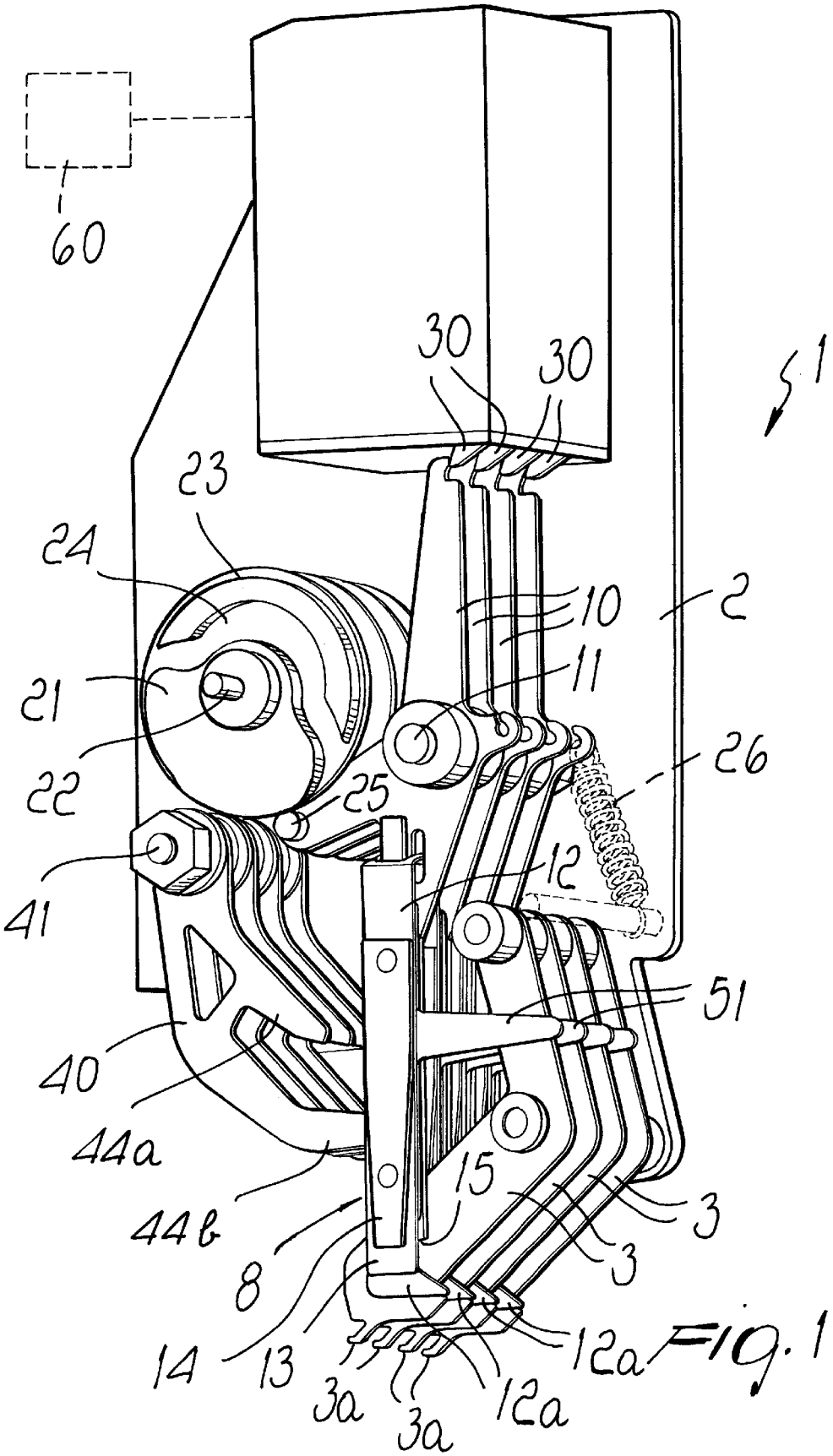
FIG. 1 is a schematic perspective view of the device according to the invention.

With reference to the above figures, the device according to the invention, generally designated by the reference numeral 1, comprises a frame 2 which supports a set of fixed stripers 3 which are laterally adjacent one another and are arranged on the outer side of the needle bed or needle beds 4*a* and 4*b* of a knitting machine or the like.

Each one of said stripers 3 has a passage 5 for a thread 6 to be fed to the needles 7 arranged in the needle beds of the machine.

For each one of the stripers 3 there is a clamping and cutting element, generally designated by the reference numeral 8, for the thread 6 arriving from the corresponding striper 3.

Each clamping and cutting element 8 is movable from a standby position, in which it is laterally adjacent to the corresponding striper 3 on the outer side of the needle beds 4*a* and 4*b* of the machine and clamps the thread 6 arriving from the corresponding striper 3, to an active position, in which at least its region that engages the thread 6 is arranged on the inner side of the needle beds 4*a* and 4*b* of the machine so as to arrange the thread 6 transversely to the needle beds of the machine and then release it, and vice versa, in order to perform clamping and cutting of the thread 6 arriving from the corresponding striper 3, as will become apparent hereinafter.

In the device according to the invention there are first actuation means which comprise a programmable electronic controller 60 for the individual actuation, according to a preset program, of each clamping and cutting element 8 in order to actuate its transfer from the standby position to the active position and vice versa.

More particularly, the stripers 3 have a flat laminar body and have, at their end directed toward the needle beds 4*a* and 4*b* of the machine, a lug 3*a* which forms a support for the thread 6 which is dispensed by the contiguous striper 3 during the feeding of said thread 6 to the needles 7 of the machine.

Each clamping and cutting element 8 comprises a fixed blade 10 which is pivoted about a main shaft 11 supported, so that it can rotate about its own axis, by the frame 2 and is orientated so that its axis is parallel to the direction in which the stripers 3 are arranged side by side.

The fixed plate 10 supports, on one of its faces, a movable blade 12 which has a hook-shaped end 12*a* for engaging the thread 6.

The movable blade 12 is interposed between the fixed blade 10 and a plate 13 which is associated with the fixed blade 10 and of which a leaf spring 14 acts which presses the plate 13 constantly against the movable blade 12.

The blade 12 is movable on command along the fixed blade 10, so as to move the thread 6, engaged by its end 12*a*, so that it is clamped between the plate 13 and said movable blade 12 and then move said thread 6 against a cutting edge 15 provided at the end of the fixed blade 10 that is directed toward the end 12*a* of the movable blade 12.

The movement of the movable blade 12 in the opposite direction has the effect of releasing the thread 6 previously clamped between the plate 13 and the movable blade 12.

The clamping and cutting elements 8 are adjacent so as to correspond to the stripers 3, so that in the standby position each clamping and cutting element 8 is arranged so that the end 12*a* of the movable blade 12 lies between two contiguous stripers 3, as shown in FIG. 1.

The first actuation means comprise an actuator and means for the individual connection of each clamping and cutting element 8 to said actuator. The device further comprises selection means which are adapted to actuate or deactivate said connecting means, and said actuator and said selection means are operatively connected to the programmable electronic controller 60.

Moreover, said actuator comprises an electric motor 20 whose actuation is controlled by the programmable electronic controller 60.

The means for connecting the actuator to the clamping and cutting elements 8 comprise a set of cams 21 which have a desmodromic profile, one cam for each clamping and cutting element 8; said cams are keyed on a second shaft 22 which is arranged so that its axis lies parallel to the axis of the main shaft 11 and is connected to the output shaft of the electric motor 20.

Each cam 21 forms two paths 23 and 24 for a cam follower 25 which is mounted on an arm 10*a* of each fixed blade 10 of the clamping and cutting elements 8.

The path 23 is a standby path which lies on the outer profile of the cam 21 and is substantially circular, while the path 24 is an active path which partly lies inside the body of the corresponding cam 21.

Moreover, a spring 26 acts on each fixed blade 10 of the clamping and cutting elements 8 and constantly presses the cam follower 25 against the profile of the corresponding cam 21.

The selection means act on command on each clamping and cutting element 8 in order to produce the passage of the corresponding cam follower 25 from the standby path 23 to the active path 24.

More particularly, the selection means comprise, for each clamping and cutting element 8, a detent lever 30 which can engage or disengage, for example by means of an electromagnetic actuator or by another type of actuator controlled by the electronic controller 60, the end of the fixed blade 10 of the corresponding clamping and cutting element 8 so as to constantly keep the cam follower 25 on the standby path 23 or make it pass into the portion of the active path 24 that runs inside the body of the cam 21 thanks to the action of the spring 26.

The device also comprises second actuation means for actuating the sliding of the movable blade 12 along the fixed blade 10 in order to clamp and cut the thread 6 or to release said thread 6.

Said second actuation means comprise, for each clamping and cutting element 8, a lever 40 which is keyed, at one of its ends, to a third shaft 41 which is supported by the frame 2 so that it can rotate about its own axis.

The various levers 40 are mutually side by side so as to correspond to the clamping and cutting elements 8 that they must actuate, and the shaft 41 is parallel to the shafts 11 and 22.

The levers 40 can oscillate about the axis of the shaft 41, rigidly with respect to each other, relative to the frame 2, and one of said levers 40, or the shaft 41, is provided with an arm 40*a* which supports a cam follower 42 which engages the profile of an auxiliary cam 43 which has a desmodromic profile and is keyed on the same shaft 22 on which the cams 21 are keyed.

The cam 43 actuates the oscillation of the levers 40 about the axis of the shaft 41 which causes the movement of the movable blades 12 with respect to the fixed blades 10 of the clamping and cutting elements 8.

More particularly, each lever 40 is fork-shaped, with tines 44*a* and 44*b* which have mutually different lengths, so as to cause the movement of the movable blade 12 with respect to the fixed blade 10 only in the clamping and cutting elements 8 that are in the active position.

The tine 44*b*, which is longer, can in fact engage a pin 46 connected to the movable blade 12 of each clamping and cutting element 8 in order to actuate the movement of the movable blade 12 in the direction that produces the clamping and cutting of the thread 6 engaged by the end 12*a*, while the tine 44*a*, which is shorter, engages the pin 46 in order to cause the movement of the movable blade 12 in the opposite direction, which causes the end 12*a* to disengage the thread 6. The tine 44*a*, being shorter than the tine 44*b*, is capable of engaging the pin 46 only when the corresponding clamping and cutting element 8 is in the active position, i.e., when it is moved toward the inner side of the needle beds 4*a* and 4*b*, in which the pin 46 is closer to the levers 40.

When the corresponding clamping and cutting element 8 is in the standby position, the tine 44*b*, despite making contact with the pin 46, has no effect on the movement of the movable blade 12 which keeps the previously clamped and cut thread 6 engaged.

For the sake of completeness in description, it should be noted that each movable blade 12 can be provided with an arm 51 which allows to manually move the movable blade 12 with respect to the fixed blade 10 during the threading of the thread 6.

Again in order to facilitate the threading of the thread 6, the passage 5 of each striper 3 can be laterally open.

The operation of the device according to the invention is as follows.

Figure 2:
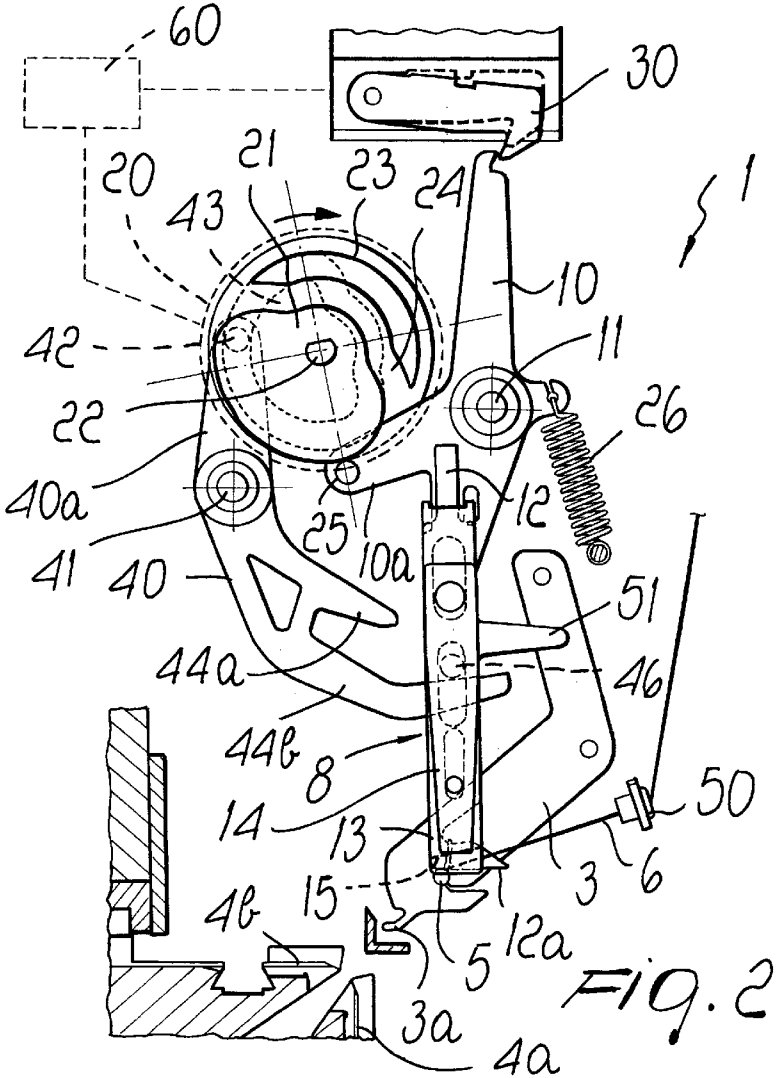

Initially, the threads 6 to be fed to the needles 7 of the machine arrive from adapted thread guides 50 which are supported by said frame 2 and each of which passes through the passage 5 of the corresponding striper 3. Their end is clamped between the movable blade 12 and the plate 13 of the clamping and cutting elements 8 that lie in the standby position, i.e., so that their end that engages the thread 6 is arranged proximate to the corresponding striper 3 on the outer side of the needle beds 4*a* and 4*b* of the machine. The ends of the fixed blades 10 that lie opposite the end 12*a* of the movable blades 12 are engaged by the corresponding detent levers 30 of the selection means, as shown in FIG. 2.

When, according to a knitting program which is preset in the electronic controller 60, one or more of the threads 6 must be fed to the needles 7 of the machine, the corresponding detent lever 30 is disengaged, by means of a command which originates from the electronic controller 60, from the end of the fixed blade 10 that corresponds to said thread 6 that must be fed.

It should be noted that in order to facilitate the disengagement of the lever 30 from the end of the fixed blade 10 it is possible to provide, along the standby path 23 of the cams 21, a slightly raised portion which achieves the separation of the end of the fixed blade 10 from the corresponding detent lever 30.

Owing to the fact that the fixed blade 10 is disengaged from the detent lever 30, the cam follower 25, thanks to the action applied by the spring 26, moves into the portion of the working path 24 that lies inside the body of the corresponding cam 21 which is turned by the electric motor 20, which is also actuated by the electronic controller 60.

Figure 3:
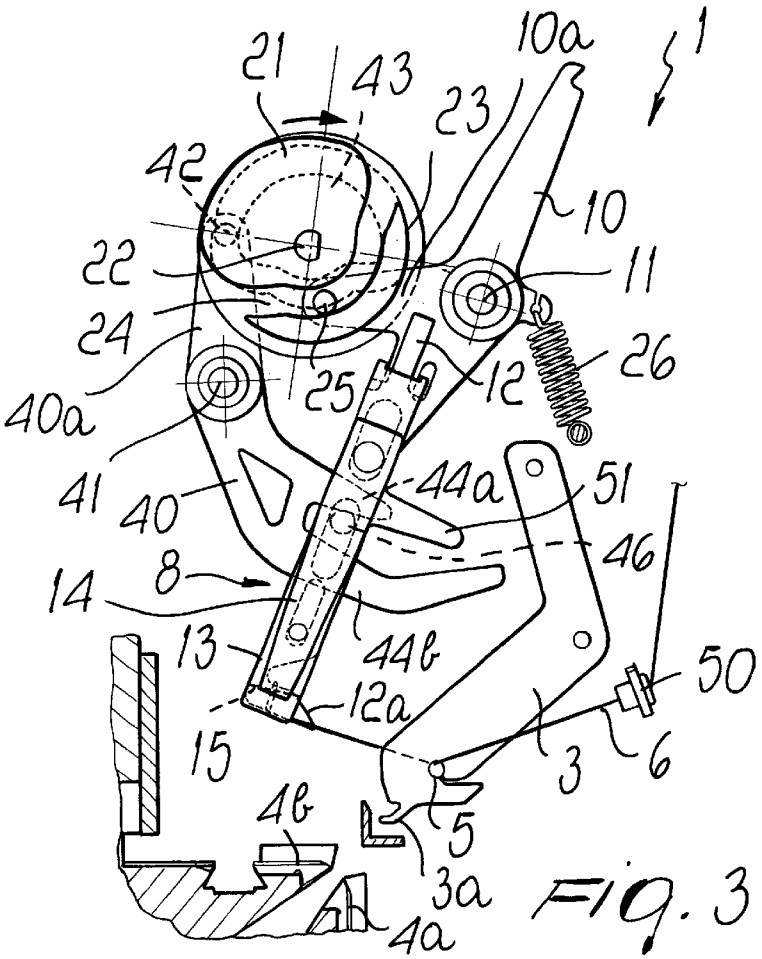
FIGS. 2 to 9 are schematic views of an operating sequence of the device during the transition of a clamping and cutting element from the standby position to the active position and vice versa.

Owing to the engagement of the cam follower 25 with said portion of the active path 24, the corresponding clamping and cutting element 8, with the thread 6 arriving from the passage 5 of the corresponding striper 3 engaged thereon, turns about the main shaft 11 and moves, from the outer side of the needle beds 4*a* and 4*b*, to their inner side, i.e., it passes from the standby position to the active position. In this manner, the thread 6 is arranged transversely to the needle beds 4*a* and 4*b* of the machine, as shown in FIG. 3.

Figure 4:
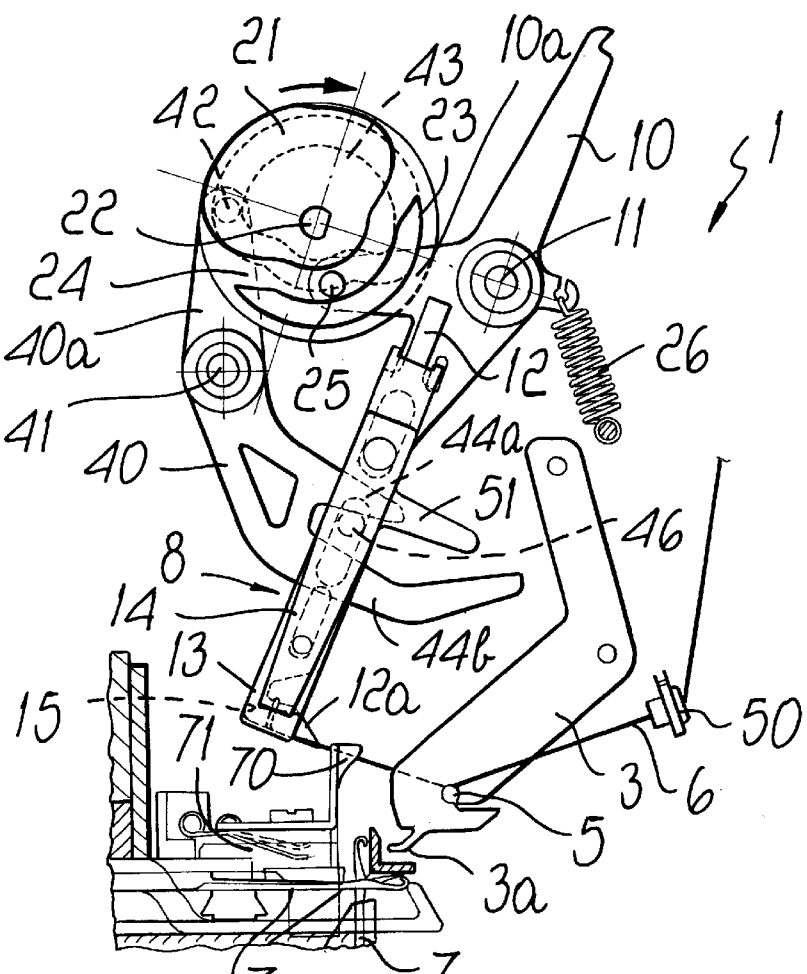

If the machine is provided with a thread capturing hook 70, the thread 6 is engaged by said hook 70 and is conveyed to the selvage retention clamps 71 or is engaged directly by the needles 7 that are moved to knit in order to form fabric, as shown in FIG. 4.

Figure 5:
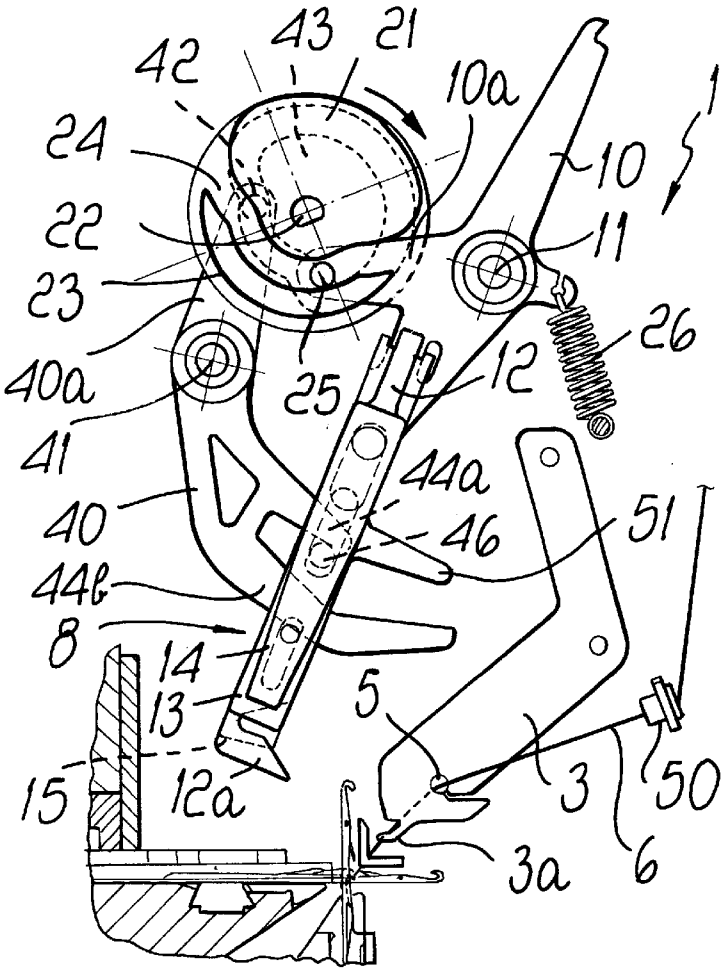

The transfer of the clamping and cutting element 8 from the standby position to the active position moves the pin 46 between the tines 44*a* and 44*b* of the corresponding lever 40, and the oscillation of said lever 40 about the axis of the shaft 41 caused by the cam 43 produces the movement, thanks to the engagement of the tine 44*a* with the pin 46, of the movable blade 12 with respect to the fixed blade 10 toward the needle beds 4*a* and 4*b* of the machine, i.e., away from the shaft 11, with consequent disengagement of the thread 6 by the end 12*a* and the plate 13. The cam 43 is appropriately synchronized with the cams 21 so that the release of the thread 6 occurs directly after engagement by the hook 70 or the first needles 7 that are moved to knit, as shown in FIG. 5.

At this point the motor 20 can be stopped by the electronic controller 60, so as to maintain the feeding of the thread 6 until it is required by the knitting according to the pattern to be formed.

Figure 7:
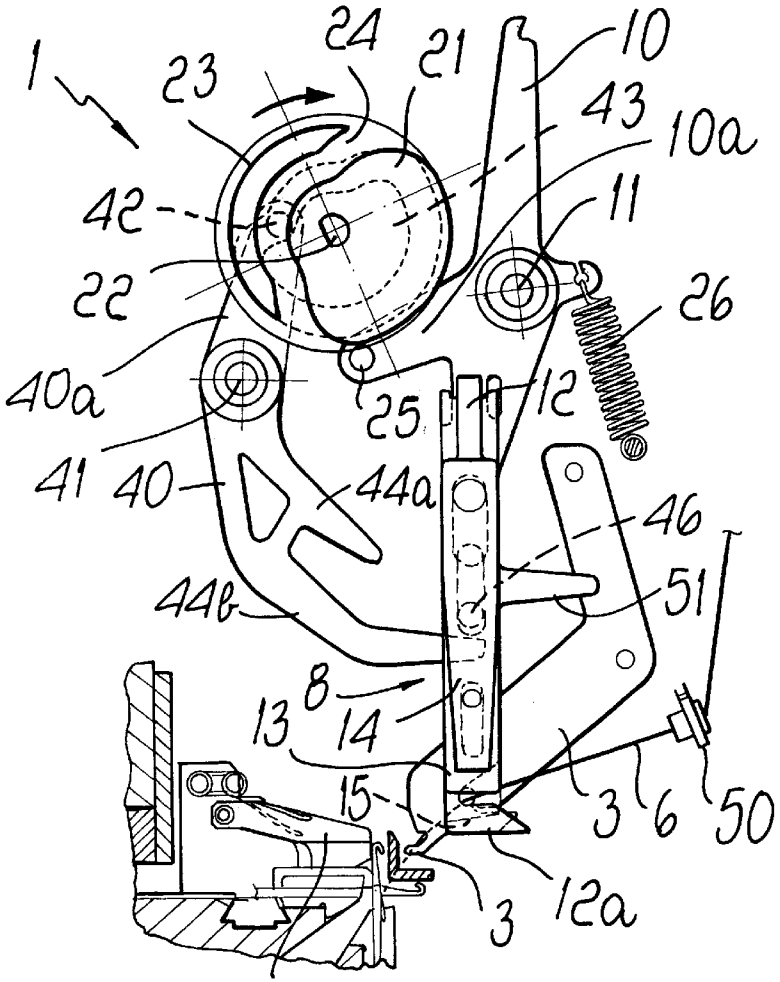
Figure 6:
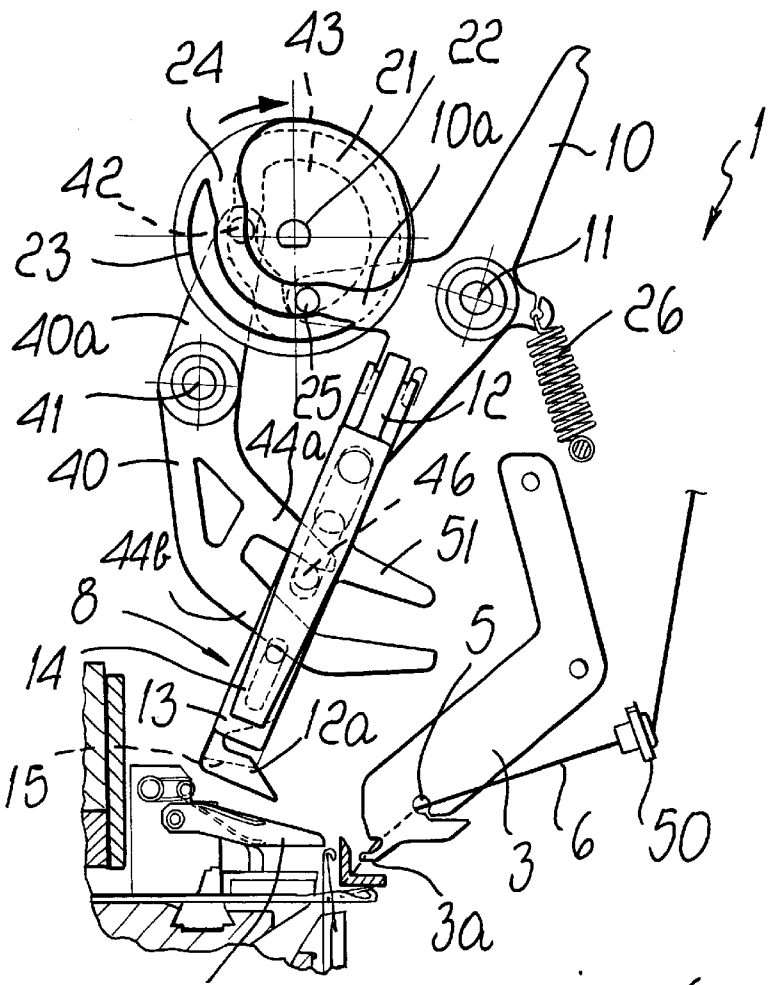
Figure 9:
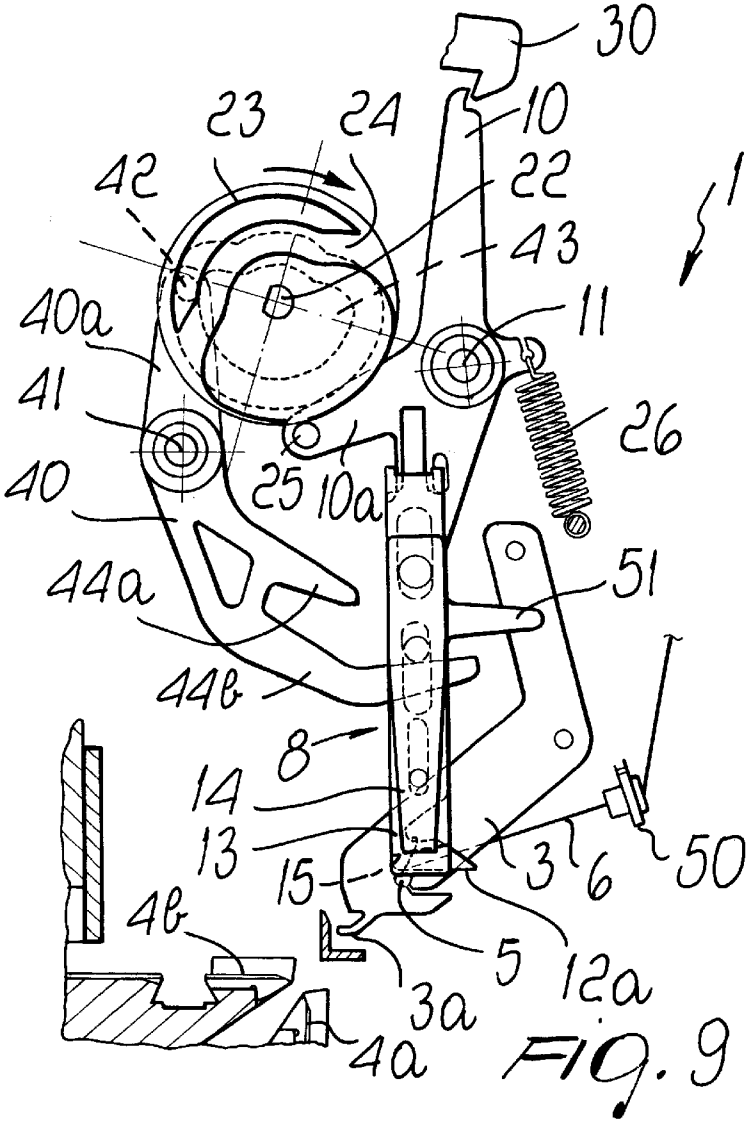

When, according to the preset knitting program, one wishes to interrupt the feeding of the thread 6, or at the end of the needle beds 4*a* and 4*b* where the thread 6 is clamped by the selvage retention clamps 71, the electronic controller 60 again actuates the electric motor 20, which by causing the rotation of the cams 21 causes the cam follower 25 to shift from the portion of the active path 24 that lies inside the body of the corresponding cam 21 to the portion that lies on the outer side of the cam 21 and is in common with the standby path 23, as shown in FIGS. 6 and 7.

In this manner, the clamping and cutting element 8 passes from the active position to the standby position and engages, with the end 12*a* of the movable blade 12, again spaced from the cutting edge 15, the portion of thread 6 that run from the passage 5 of the corresponding striper 3 to the lug 3*a* of the contiguous striper, as shown in FIG. 7.

Then, as a consequence of the oscillation of the lever 40 caused by the rotation of the cam 43, the tine 44*b* of the lever 40 acts on the pin 46, causing the movement of the movable blade 12 in the direction that causes its end 12*a* to move toward the cutting edge 15.

Figure 8:
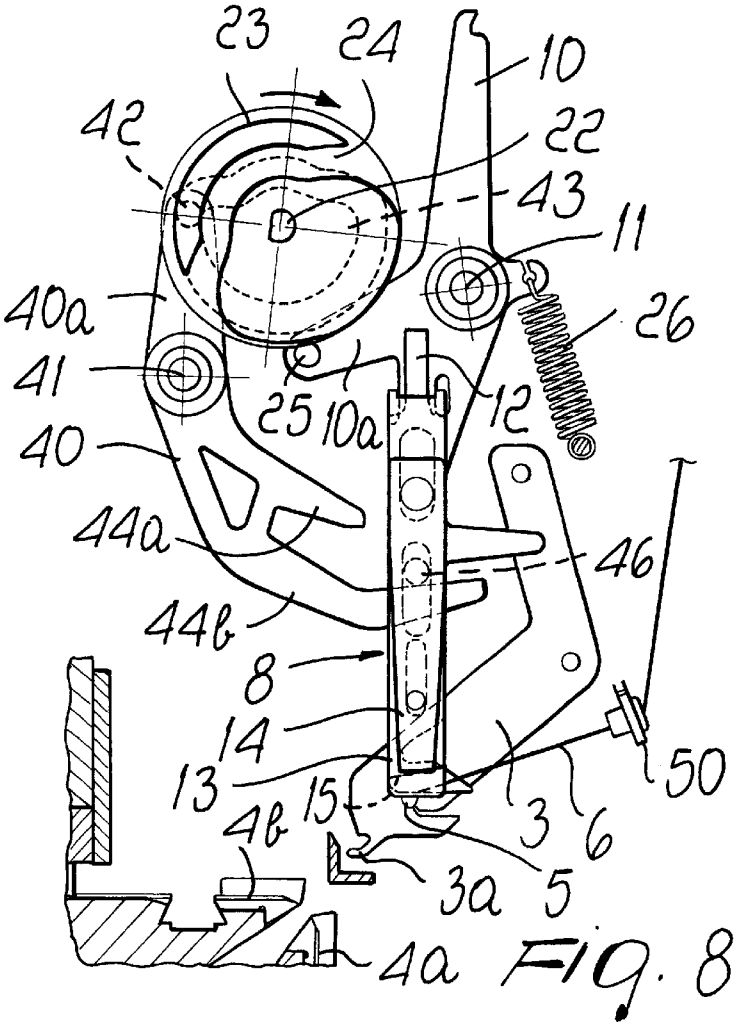

The thread 6 is then clamped between the movable blade 12 and the plate 13 and is then cut by the cutting edge 15, as shown in FIG. 8.

The return of the clamping and cutting element 8 to the standby position causes the corresponding detent lever 30 to engage the end of the corresponding fixed blade 10, retaining the clamping and cutting element 8 in the standby position until the release of the corresponding detent lever 30 from the fixed blade 10 is again actuated.

It should be noted that according to the program preset in the electronic controller 60, it is also possible to move a plurality of clamping and cutting elements 8 simultaneously into the active position.

In practice it has been observed that the device according to the invention fully achieves the intended aim, since by controlling the dispensing of the thread conveyed by the stripers by means of a programmable controller it is possible to produce fabrics with particular pattern effects which can be changed without acting on the mechanical part of the machine.

Moreover, the device according to the invention allows to eliminate the cams that are fixed to the needle beds in order to actuate the stripers and are instead necessary in order to actuate conventional devices, thus also achieving a structural simplification of the machine.

The device thus conceived is susceptible of numerous modifications and variations, all of which are within the scope of the inventive concept; all the details may furthermore be replaced with other technically equivalent elements.

In practice, the materials used, as well as the dimensions, may be any according to requirements and to the state of the art.

The disclosures in Italian Patent Application No. M199A001168 from which this application claims priority are incorporated herein by reference.

What is claimed is:

1. A device for selectively feeding threads in knitting machines, comprising: a set of fixed stripers arranged side by side and provided on an outer side of needle bed or beds of the machine, each one of said stripers having a passage for a thread to be fed to needles of the machine; an element for clamping and cutting, with a linear motion, the thread arriving from the corresponding striper being provided for each one of said stripers; wherein said clamping and cutting element is movable from a standby position, in which it is laterally adjacent to the corresponding striper on the outer side of the needle bed of the machine and clamps the thread arriving from the corresponding striper, to an active position, in which at least a region thereof that engages the thread is arranged on an inner side of the needle bed of the machine in order to arrange the thread transversely to the needle bed of the machine and then release the thread, and vice versa, in order to clamp and cut the thread arriving from the corresponding striper; and wherein the device further comprises first actuation means which act on said clamping and cutting element in order to move it from said standby position to said active position and vice versa; said first actuation means comprising a programmable electronic controller for individual actuation, according to a preset program, of each clamping and cutting element for transfer thereof from the standby position to the active position and vice versa.

2. The device of claim 1, wherein said first actuation means comprise: an actuator and connection means for individual connection of each clamping and cutting element to said actuator; selection means which are adapted to actuate or deactivate said connection means; said actuator and said selection means being operatively connected to said programmable electronic controller.

3. The device of claim 1, comprising second actuation means which act on said clamping and cutting element in said active position in order to clamp and cut the thread arriving to the corresponding striper.

4. The device of claim 1, further comprising a main shaft, said clamping and cutting elements being pivoted, by way of one of intermediate portions thereof, about said main shaft which is orientated so that an axis thereof is parallel to a direction along which said stripers and said clamping and cutting elements are laterally adjacent; and wherein each one of said clamping and cutting elements is rotatable about said main shaft in order to pass from said standby position, in which it is laterally adjacent to the corresponding striper with its end that engages the thread, to said active position in which it is spaced, with said end, from the corresponding striper toward the inner side of the needle bed.

5. The device of claim 2, further comprising a second shaft, said connection means comprising a set of cams having a desmodromic profile, one cam for each clamping and cutting element and cam followers, said cams being keyed on said second shaft which is arranged so that its axis is parallel to said main shaft and is connected to said actuator, which is adapted to actuate said second shaft with a rotary motion about an axis thereof; each one of said cams forming two paths for one of said cam followers which is connected to an arm of the corresponding clamping and cutting element, respectively a substantially circular standby path for keeping the corresponding clamping and cutting element in the standby position and an active path for passage of the corresponding clamping and cutting element from the standby position to the active position and vice versa.

6. The device of claim 5, wherein said selection means act on command on each clamping and cutting element for passage of the corresponding cam follower from said standby path to said active path.

7. The device of claim 5, wherein said selection means comprise, for each clamping and cutting element, elastic means, and a detent lever which is adapted to engage a corresponding clamping and cutting element, in order to retain the corresponding cam follower on said standby path of the corresponding cam in contrast with said elastic means, or to disengage from the corresponding clamping and cutting element for transfer of the corresponding cam follower onto said active path of the corresponding cam.

8. The device of claim 7, further comprising an electromagnet which is connected to said programmable electronic controller, each one of said detent levers being actuated, for engagement or disengagement thereof with respect to the corresponding clamping and cutting element, by said electromagnet.

9. The device of claim 8, wherein said actuator comprises an electric motor which is connected to said programmable electronic controller and is connected, by means of an output shaft thereof, to said second shaft.

10. The device of claim 6, wherein each said clamping and cutting element comprises a fixed blade which is pivoted to said main shaft and is provided with an arm which supports said cam follower; and a spring for clamping the thread, which is associated with said fixed blade; and wherein said fixed blade supports, on a face thereof, a movable blade which is provided with a hook-shaped end for engaging the thread; said movable blade being interposed between said fixed blade and said spring; said second actuation means being engageable with said movable blade to cause sliding thereof with respect to said fixed blade in one direction in order to move the thread, engaged by said hook-shaped end, between said hook-shaped end and said spring in order to clamp the thread and then against a cutting edge of the fixed blade in order to cut the thread or in the opposite direction in order to release the thread.

11. The device of claim 10, comprising a third shaft, said second actuation means comprising a set of levers which are keyed on said third shaft which is parallel to said main shaft, each lever being able to engage only the movable blade of one of said clamping and cutting elements in the active position; a further cam follower; and an auxiliary cam which is keyed on said second shaft and can be engaged by said further cam follower wich is supported by an arm of one of said levers or of said third shaft for the oscillation of said levers about an axis of said third shaft which produces sliding of the movable blade engaged by one of said levers along the fixed blade of the clamping and cutting element in the active position.

12. The device of claim 10, wherein said stripers are arranged side by side, and each one of said clamping and cutting elements is interposed between two contiguous stripers; each one of said stripers having at least one thread passage and, at an end thereof directed toward the needle bed of the machine, a lug which forms a support for the thread dispensed by the contiguous striper, said hook-shaped end of the movable blade of the clamping and cutting element, in passing from said active position to said standby position, engaging a portion of thread that lies between the thread passage of the corresponding striper and the lug of the contiguous striper.

* * * * *